US010104480B2

(12) United States Patent
Kornagel et al.

(10) Patent No.: US 10,104,480 B2
(45) Date of Patent: Oct. 16, 2018

(54) METHOD AND FACILITY FOR REPRODUCING SYNTHETICALLY GENERATED SIGNALS BY MEANS OF A BINAURAL HEARING SYSTEM

(75) Inventors: Ulrich Kornagel, Erlangen (DE); Wolfgang Sörgel, Erlangen (DE)

(73) Assignee: Sivantos GmbH, Erlangen (DE)

( * ) Notice: Subject to any disclaimer, the term of this patent is extended or adjusted under 35 U.S.C. 154(b) by 1413 days.

(21) Appl. No.: 12/079,143

(22) Filed: Mar. 25, 2008

(65) Prior Publication Data

US 2008/0240449 A1 Oct. 2, 2008

(30) Foreign Application Priority Data

Mar. 29, 2007 (DE) ..... 10 2007 015 223

(51) Int. Cl.
*H04R 5/00* (2006.01)
*H04R 25/00* (2006.01)
*H04S 1/00* (2006.01)

(52) U.S. Cl.
CPC ..... *H04R 25/552* (2013.01); *H04S 1/005* (2013.01); *H04S 2420/05* (2013.01)

(58) Field of Classification Search
CPC .... H04R 25/552; H04S 1/005; H04S 2420/05
USPC ..... 381/23.1
See application file for complete search history.

(56) References Cited

U.S. PATENT DOCUMENTS 4,589,128 A 5/1986 Pfleiderer
5,014,319 A * 5/1991 Leibman ..... 381/316
5,033,086 A 7/1991 Fidi
6,839,447 B2 1/2005 Melanson
7,844,062 B2 11/2010 Bäuml et al.
2005/0069162 A1* 3/2005 Haykin et al. ..... 381/312
2005/0271213 A1 12/2005 Kim

FOREIGN PATENT DOCUMENTS

DE 2817777 A1 10/1978
EP 0040739 A1 12/1981
EP 1651005 A2 4/2006
EP 1 750 482 A2 2/2007
GB 2224186 A 4/1990

OTHER PUBLICATIONS

Blauert et al., English translation of/and German document, "Interaural Time Difference", Kapitel "Interaurale Zeitdifferenz", 1974, pp. 112-125.

Zwicker, „Psychoacoustics—Facts and Models, Springer, Berlin Heidelberg New York, 1999, pp. 293-313, Kapitel: "Binaural Hearing".

(Continued)

*Primary Examiner* — Ori Nadav

(74) *Attorney, Agent, or Firm* — Laurence A. Greenberg; Werner H. Stemer; Ralph E. Locher

(57) ABSTRACT

Synthetically generated signals are reproduced via a binaural hearing system, which includes two hearing devices. After reproducing a first signal via the first hearing device a reproduction of a second signal via the second hearing device is also carried out delayed by a defined time interval. The additional time delay is to be quantified such that the impression of a sound amplification is produced with a hearing system wearer.

12 Claims, 2 Drawing Sheets

(56) References Cited

OTHER PUBLICATIONS

Blauert, English Translation of/and German document of "Cumulalative Localization and the Law of the First Wavefront", „Räumliches Hören—Nachschrift—Neue Ergebnisse und Trends seit 1972, Verlag S. Hirzel, Stuttgart, 1985, pp. 46-53.
Statement of Revelance for Dominik Wegmann, "Zu Unterschieden in der Hörereigniswahmehmung bei Wellenfeldsynthese und Stereofonie im Vergleich zum natürlichen Hören", Institute for Hearing Technology and Audiology, 2005, pp. 1-78, Fachhochschule Oldenburg+ Statement of Revelance.
Invention Disclosure, Inventor cites references as technical background, Aug. 9, 2006, pp. 1-4.

* cited by examiner

METHOD AND FACILITY FOR REPRODUCING SYNTHETICALLY GENERATED SIGNALS BY MEANS OF A BINAURAL HEARING SYSTEM

CROSS REFERENCE TO RELATED APPLICATIONS

This application claims priority of German application No. 10 2007 015 223.1 DE filed Mar. 29, 2007, which is incorporated by reference herein in its entirety.

FIELD OF INVENTION

The present invention relates to a method for reproducing synthetically generated signals by means of a binaural hearing system. The invention also relates to a facility for reproducing synthetically generated signals by means of a binaural hearing system. Synthetically generated signals are to be understood in this description to mean all signals which are generated in the hearing system or in a system connected thereto. The term thus also includes inter alia signals generated by oscillators but also signals which are read out from digital storage devices and are then reproduced in analogue form.

BACKGROUND OF INVENTION

In many cases, a hearing aid with two hearing devices (binaural hearing aid, so called binaural supply) is needed or expedient for the adequate supply of a hearing-impaired patient. Nowadays, digitally programmable hearing systems are used almost exclusively for this, in other words hearing systems, the electroacoustic characteristics of which can and must be externally adjusted ("adapted") by way of a computer. The main advantage (of digitally) programmable hearing systems lies in the fact that a plurality of electro acoustic parameters can be adjusted, in order to compensate more precisely for the hearing loss. With these hearing devices, the signal processing can take place in an analogue fashion (digitally programmable analogue hearing systems) or in a digital fashion (fully digital hearing systems).

Fully digital hearing devices are hearing systems which convert the analogue microphone signal into a digital signal. The digital signal is then processed according to the commands of the programmed software (algorithm) and the switching circuit integrated on the chip. The digital signals are then converted back into analogue signals and forwarded to the receiver. The incoming signal is measured here at specific time intervals (signal sampling). The more frequent the signal sampling, the better the reproduction of the input signal. The digitalization provides for significantly more complex analyses and filterings in respect of an optimum useful signal/interference noise ratio than was possible with analogue systems.

SUMMARY OF INVENTION

Wirelessly connected hearing device systems allow communication between the right and left hearing device in the case of a binaural supply. However, the conversion of wirelessly received instructions, such as for instance the program switchover, and in particular the acoustic output in both hearing devices, is not carried out in a synchronized fashion. A temporal offset becomes troublesome particularly in the case of an output of signal tone sequences (beeps). If synthetically generated signals are to be output binaurally in such a hearing system, a specific synchronicity behavior of the two devices is thus necessary in order to avoid interfering effects for the hearing device system wearer.

EP 1 750 482 A2 discloses a method for synchronizing signal tones, in which counters are equated in both hearing devices of the binaural hearing system by means of a synchronization signal. A very extensive synchronization is possible with this solution; the outlay for realizing this solution is however relatively high.

The object underlying the present invention is to solve the problem of synchronizing hearing devices in a binaural hearing system during the reproduction of synthetically generated signals with as little technical outlay as possible and thus as cost-effectively as possible.

This object is achieved by a method and a facility for reproducing synthetically generated signals by means of a binaural hearing system as claimed in one of the independent claims. The invention relates here to the psychoacoustic knowledge that small temporal shifts during the reproduction, which occur in the case of an imperfect synchronization, can cause an unwanted shift of the virtual switching source in the room in the direction of one of the devices to be perceived by the hearing system wearer. If by contrast the temporal shift lies in a somewhat higher range during the reproduction however, this shift is perceived by the hearing system wearer as a sound broadening (fade-out, reverberence), which is not perceived as interfering but instead even generally enhances the subjective sound impression.

The basic idea behind the present invention thus relates to dispensing with the need for as complete a synchronization of the two hearing devices of the binaural hearing system as possible by consciously accepting a temporal shift, which is however to be quantified such that the result is not perceived by the hearing system wearer as interfering.

BRIEF DESCRIPTION OF THE DRAWINGS

The present invention is now described in more detail with reference to the appended figures and with the aid of preferred exemplary embodiments, in which.

DETAILED DESCRIPTION OF INVENTION

The exemplary embodiments illustrated in more detail below represent preferred embodiments of the present invention. On the basis of this description, the person skilled in the art is thus easily able to discover further embodiments him/herself, the complete illustration of which would however go beyond the scope of this description.

An inventive binaural hearing system consists of a left hearing device HG1 and a right hearing device HG2. A preferably low-rated data link STX for transmitting control or synchronization signals is present between both hearing devices HG1 and/or HG2. This data link normally satisfies basic requirements and signals are typically only exchanged from time to time and not necessarily continuously.

Figure 1:
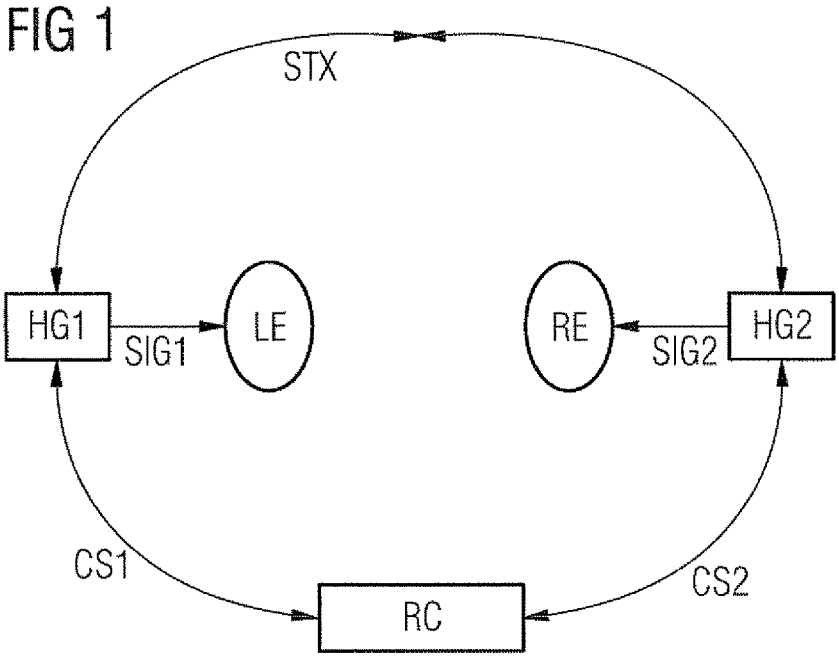
FIG. 1 shows a schematic representation of the typical design of a binaural hearing system.

In the example shown in FIG. 1, the hearing device HG1 supplies the left ear LE, whereas the hearing device HG2 supplies the right ear RE of the hearing system wearer. FIG. 1 also shows a remote controller RC, as is typically used nowadays with wireless binaural hearing systems. This remote controller can be connected here to both hearing devices or also only to one hearing device (CS1, CS2).

The present invention deals with the situation in which acoustic signals SIG1 and SIG2 are to be output to the hearing system wearer by means of the hearing devices of the binaural hearing system. Such a situation can exist for instance if the hearing system wearer wishes to switch the hearing devices by way of the remote controller RC to a (another) operating state, and the hearing system wearer is now to be notified of this change. Additional automatically generated signals can be output for instance with a program switchover, or a notification of status information of the system to the hearing system wearer, etc. The signals to be output are herewith typically generated synthetically. For reproduction purposes, these digital signals are output to the loudspeaker of the respective hearing device generally following a preceding digital analogue conversion.

The signaling is herewith typically triggered by one of the two hearing devices connected to the hearing system. The reproduction is to be carried out here such that it is binaurally perceived as a standardized event. To this end, a transmission of the trigger pulse is necessary between the two devices. This transmission is typically carried out using electromagnetic or magnetically inductive means with the aid of the digital transmission method. All known single and multiple carrier methods, such as a for instance BPSK, QPSK, QAM, OFDM etc. as well as time or frequency multiplex methods (TDMA, CDMA etc.) are essentially considered for modulation purposes. Channel coding methods for fault detection and fault correction are typically used, which requires decoding at the receiver. A packet by packet multiplexed transmission of different data is also provided, which results in the need for buffers. A transmission thus cannot take place instantaneously, but instead with a certain temporal delay, which can be roughly estimated at least on the transmitting side but cannot always be determined precisely as a whole.

In the ideal case, both devices HG1 and/or HG2 would be synchronized exactly. The signals could then be output in precise synchrony and are thus, as actually desired, perceived centrally. A method suited to this was described in EP 1 750 482 A2. However, an exact synchronization practically signifies an increased hardware and energy outlay, which is to be saved. According to the present invention, a perfect synchronization is intentionally omitted, instead provision is made for the reproduction of a second signal SIG2 by means of the second hearing device HG2 to be additionally delayed by a defined second time interval DT2, following a reproduction of a first signal SIG1 by means of the first hearing device HG1. The sequence of hearing devices can naturally also be exchanged. In this way, the term "additionally delayed" is also understood to mean that a further intentional delay is performed in addition to the unavoidably delays occurring as a result of the afore-described transmission method. DT2 denotes the additional delay.

Figure 2:
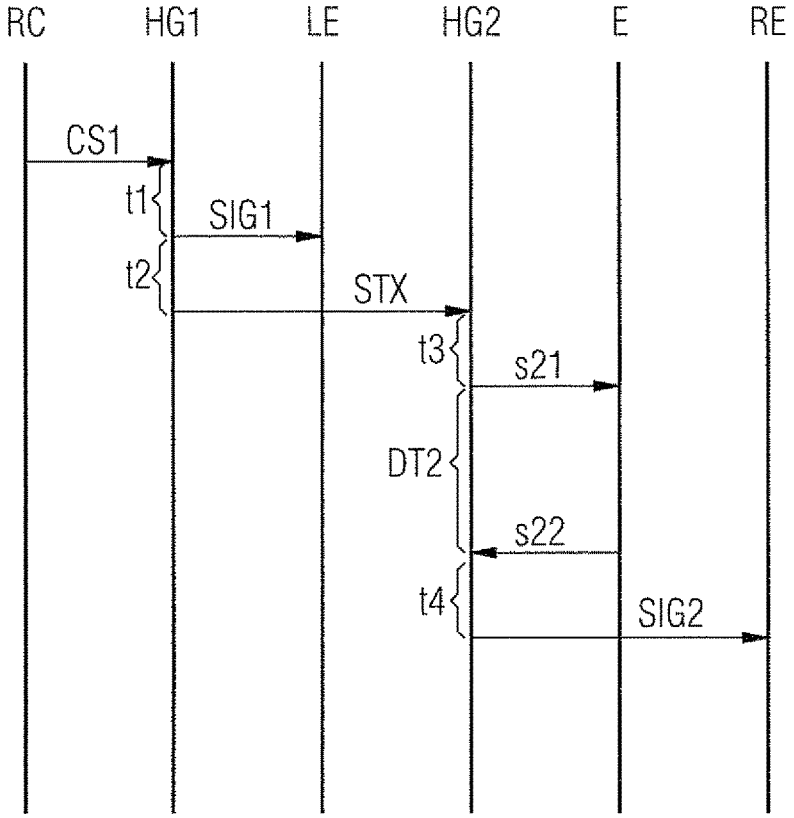
FIG. 2 shows a sequential diagram for the schematic illustration of the method according to the invention in accordance with a preferred exemplary embodiment.

In the example shown in FIG. 2, the hearing device HG1, which is assigned to the left ear LE of the hearing system wearer, is operated as a 'master', whereas the hearing device HG2, which is assigned to the right ear RE, responds as a 'slave'. In this example, the remote controller RC sends a signal CS1 to the hearing device HG1, whereupon the hearing device HG1 outputs the signal SIG1 to the left ear LE after a time interval t1. The size of the time interval t1 is essentially determined here by the lead time of the signal processing in the hearing device HG1. After an additional time interval t2 has elapsed, the hearing device HG1 sends a signal STX to the hearing device HG2. The hearing device HG2 thereupon sends a corresponding signal to the facility E with a time delay t3, said facility E measuring and effecting the additional time delay DT2 in terms of its purpose. After this time interval DT2 has elapsed, the facility E sends a corresponding signal back to the hearing device HG2, which thereupon outputs the signal SIG2 to the right ear RE after an additional time interval t4 has elapsed.

In a modification of this exemplary embodiment, the signal STX could also be sent from the hearing device HG1 to the hearing device HG2, before the hearing device HG1 outputs the signal SIG1 to the left ear LE. In this case, it would then be expedient to quantify the time interval DT2 to be accordingly larger because the triggering signal STX arrives at the hearing device HG2 accordingly earlier.

In the exemplary embodiment of the method sequence illustrated schematically in FIG. 2, it is meaningful if the facility E is accommodated in the hearing device HG2 in order to quantify and generate the time delay DT2.

Figure 3:
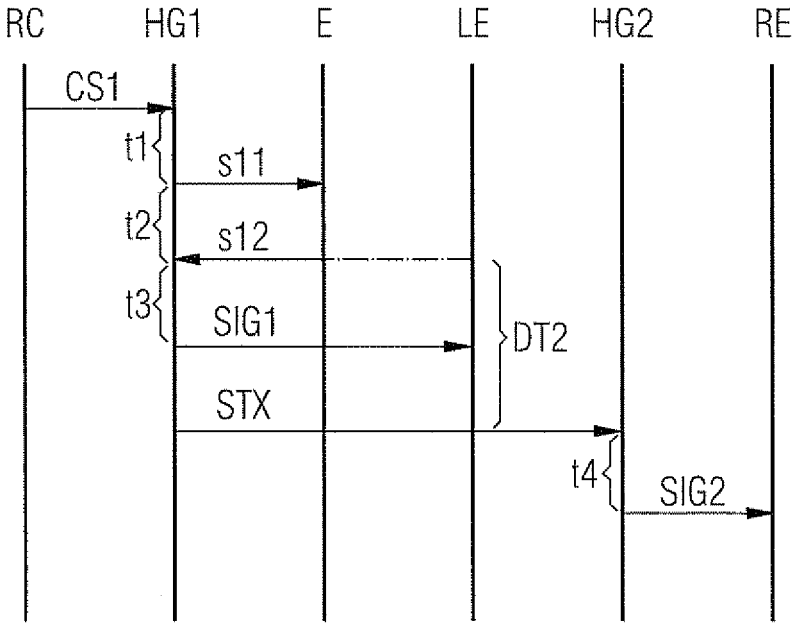
FIG. 3 shows a further sequential diagram for schematically illustrating a further preferred exemplary embodiment of the method according to the invention and FIG. 4 shows a further sequential diagram for schematically illustrating a further preferred exemplary embodiment of the method according to the invention.

With another preferred exemplary embodiment of the invention which is illustrated schematically in FIG. 3, the facility E for quantifying the time delay DT2 is accommodated in the hearing device HG1. As in the previous case, the remote controller sends a signal CS1 to the hearing device HG1, which sends a signal s11 to the facility E once a time interval t1 has elapsed, said facility E then calculating the appropriate variable of the time delay DT2. Once a time interval t2 has elapsed, the facility E transmits the result in the form of the signal s12 back to the hearing device HG1, which thereupon outputs the signal SIG1 to the left ear LE once an interval t3 has elapsed. After the time interval DT2 has elapsed, the hearing device HG1 transmits the signal STX to the hearing device HG2, measured from the time of reception of the signal s12, said hearing device HG2 thereupon outputting the signal SIG2 to the right ear after the time interval t4 has elapsed.

The person skilled in the art identifies on the basis of the present description of the invention and the exemplary embodiments without difficulties that further modifications to the exemplary embodiment described here are possible. It is ultimately essential that the overall time delay with the signal output between the two ears of the hearing system wearer lies in a range which results in the desired psychoacoustic result of a perception which is not regarded as interfering.

Psychoacoustic examinations now show that it is possible to quantify the additional second time delay DT2 such that the impression of a sound amplification occurs with the hearing system wearer. The term sound amplification is understood by the psychoacoustician to mean a sound change, which can also be referred to as fade-out (reverberance). Sound changes of this type are generally perceived by the hearing system wearer to be pleasant rather than interfering.

Such an unwanted sound change occurs, as psycoacoustic experiments show in this connection, if the second time delay DT2 lies in the range of approximately 1 ms to approximately 50 ms. A choice of time delay DT2 in this range generally guarantees that the perception of the hearing system wearer neither results in an unwanted spatial characteristic of the virtual switching source, nor in a complete divergence of the reproducing signals into two separate signals. If however the delay between the two devices is too large, the impression of a unified hearing event is lost. An echo is produced; the stereo signal is thus broken down into two individually perceptible monosignals.

In this context, experiments show that the second time delay DT2 is advantageously to lie in the range between approximately 4 ms to approximately 20 ms. Optimum hearing impressions result if the second time delay DT2 lies in the range of approximately 5 ms to approximately 15 ms.

With these details it should be borne in mind that the hearing impression is ultimately dependent on the overall time delay between the reproduction of the signals SIG1 and/or SIG2 on the ears LE and/or RE. Provided the response times and transmission times t1, t2, t3 or t4 are essentially smaller than the time delay DT2, the influence of these additional times is negligible. If this is no longer the case however for reasons of the selected transmission method between the hearing devices, then the influence of these transmission and response times on the overall time delay is to be considered accordingly, with the quantification of the additional time delay DT2. This should however not be a problem for the person skilled in the art on the basis of the present description. In these cases, the specified temporal orders of magnitude are thus related to the overall time delay and not to the time interval DT2 alone. In the normal case, the influence of the times t1, t2, t3 and t4 is however so minimal that they can be ignored by comparison with the time delay DT2.

According to a further preferred exemplary embodiment of the invention, further improvements in the sound impression for the hearing system wearer can herewith be achieved in that the signal level of the subsequently reproduced signal SIG1 and/or SIG2 is raised by comparison with the signal level of the previously reproduced signal SIG2 and/or SIG1 upon reproduction. As a result, lateralization effects which are possibly still present can potentially be reduced individually by the law of the first wave front (also referred to as the "precedence effect"). An increase in the volume level within the scope of this procedure also referred to as 'trading' is also to lie in the region between 0 and 12 dB, particularly advantageously and preferably in the range between 0 and 3 dB. The reader learns further details for expediently measuring this increase in the volume level and the psychoacoustic basis for this purpose from the publication J. Blauert, "Räumliches Hören", S. Hirzel-Verlag, Stuttgart 1972, ISBN 3-7776-0250-7 for instance. In addition, the following publications by the same author contain basic information, which could provide the person skilled in the art with valuable details in respect of possible embodiments of the invention.

Jens Blauert: Räumliches Hören [Spatial hearing]. S. Hirzel-Verlag, Stuttgart 1972, ISBN 3-7776-0250-7

1st Postcript. Neue Ergebnisse und Trends seit 1972.[New results and trends since 1972] 1985, ISBN 3-7776-0410-0

2nd Postscript. Neue Ergebnisse und Trends seit 1982 [New results and trends since 1982]. 1997, ISBN 3-7776-0738-X Jens Blauert: Spatial Hearing. The Psychophysics of Human Sound Localization. The MIT Press, USA-Cambridge Mass.

1st Edition, 1983, ISBN 0-262-02190-0

Revised Edition, 1996, ISBN 0-262-02413-6

Jens Blauert: An Introduction to Binaural Technology. In: Robert H. Gilkey, Timothy R. Anderson (Eds.): Binaural and Spatial Hearing in Real and Virtual Environments. Lawrence Erlbaum, USA-Mahwah N.J. 1996, S. 593-609, ISBN 0-8058-1654-2

Jens Blauert (Eds.): Communication Acoustics. Springer, Berlin/Heidelberg/New York 2005, ISBN 3-540-22162-X Further improvements in the hearing impression are possible according to a further preferred exemplary embodiment, if a signal inversion is performed with one of the two hearing devices. The basics for this are likewise described in the publications by Blauert. Further information on this can be found in the thesis "Zu Unterschieden in der Hörereigniswahrnehmung bei Wellenfeldsynthese und Stereofonie im Vergleich zum natürlichen Hören"[Differences in the hearing event perception with wave field synthesis and stereophony compared with natural hearing] by Dominik Wegmann, Institut für Hörtechnik und Audiologie, Fachhochschule Oldenburg/Ostfriesland/Wilhelmshaven, Fachbereich Bauwesen und Geoinformation (B+G), Ofener Str. 16, D-26121 Oldenburg. The content of all publications cited here is herewith included by referring in detail to the disclosure content of the present description.

Figure 4:
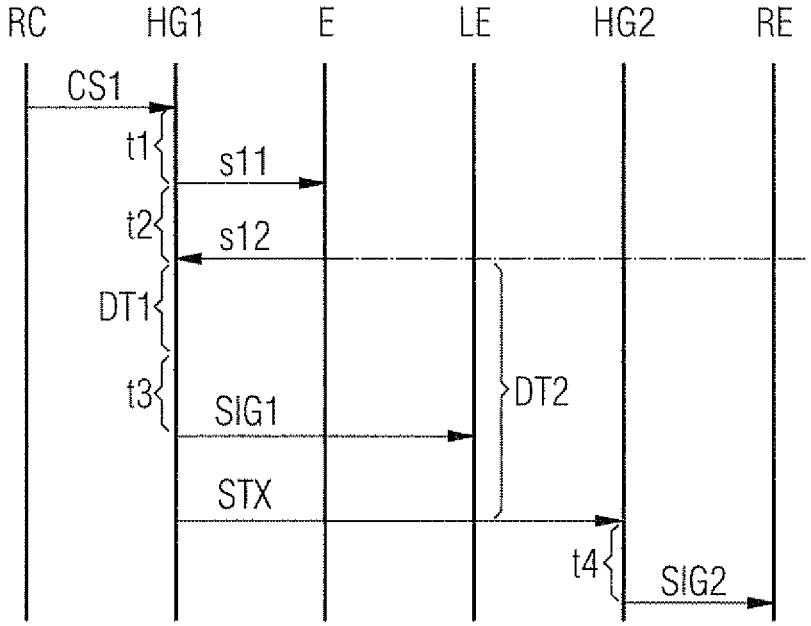

It must however essentially always apply that the maximum transmission time may not be greater than the upper limit of the preferred region for the effective time delay between the output of the signals SIG1 and SIG2. If in special cases for technical reasons the transmission time between the hearing devices is particularly great, provision can be made for a delay in hearing device HG1 instead of a delay in hearing device HG2. This can occur for instance in the situation shown in FIG. 4 by means of corresponding measurements of the time interval DT1, with it being possible, depending on the embodiment variant for DT1, to be less than, equal to or larger than DT2.

The present invention is advantageously realized using a facility E for reproducing synthetically generated signals in a binaural hearing system, which provides for the expedient measurement and if necessary generation of the time delay DT2. In any case, the time delay DT2 is to be quantified such that the impression of a sound amplification is produced with a hearing system wearer. This is herewith generally achieved in that the time delay DT2 is quantified such that the overall time delay lies between the reproduction of the signals SIG1 and SIG2 in the psychoacoustic time regions which are perceived as expedient.

The invention claimed is:

1. A method for reproducing synthetically generated signals via a binaural hearing system having a first hearing device and a second hearing device, the method comprising the following steps:

reproducing a first signal via the first hearing device;

reproducing a second signal via the second hearing device after the reproduction of the first signal;

delaying the reproducing of the second signal by a defined additional time delay in addition to delays unavoidably occurring due to transmission of a trigger signal from the first hearing device to the second hearing device or from the second hearing device to the first hearing device; and quantifying the additional time delay to cause a temporal distance between reproducing the first signal and reproducing the second signal to lie in a range from 1 ms to 50 ms, to provide a hearing system wearer with an impression of a broadening;

wherein the first signal and the second signal are synthetically generated signals.

2. The method according to claim 1, which further comprises quantifying the additional time delay to cause the temporal distance between the reproduction of the first signal and the second signal to lie in a range from 4 ms to 20 ms.

3. The method according to claim 1, which further comprises quantifying the additional time delay to cause the temporal distance between the reproduction of the first signal and the second signal to lie in a range from 5 ms to 15 ms.

4. The method according to claim 1, which further comprises raising a signal level of a subsequently reproduced signal during the reproduction in comparison with a signal level of a signal reproduced earlier.

5. The method according to claim 1, which further comprises providing the sound amplification as an increase in a volume level in a range from 0 to 12 dB.

6. The method according to claim 1, which further comprises providing the sound amplification as an increase in a volume level in a range from 0 to 3 dB.

7. The method according to claim 1, which further comprises performing a signal inversion in one of the first or second hearing devices.

8. The method according to claim 1, which further comprises delaying the reproduction of the first signal via the first hearing device by a first defined time interval.

9. A facility for influencing a reproduction of synthetically reproduced signals in a binaural hearing system, the facility comprising:

a first hearing device reproducing a first signal;

a second hearing device reproducing a second signal, after the reproduction of the first signal by said first hearing device;

the reproduction of the second signal being delayed by a defined additional time interval in addition to delays unavoidably occurring due to transmission of a trigger signal from said first hearing device to said second hearing device or from said second hearing device to said first hearing device; and the additional time delay being quantified to cause a temporal distance between reproducing the first signal and reproducing the second signal to lie in a range from 1 ms to 50 ms, to provide a hearing system wearer with an impression of a broadening;

wherein the first signal and the second signal are synthetically generated signals.

10. The facility according to claim 9, wherein a signal level of a subsequently reproduced signal is raised during the reproduction in comparison with a signal level of signal reproduced earlier.

11. The facility according to claim 9, wherein one of said first and second hearing devices is configured to perform a signal inversion.

12. The facility according to claim 9, wherein said first hearing device delays the reproduction of the first signal by a first defined time interval.

* * * * *